US008109800B2

(12) United States Patent
Okabe et al.

(10) Patent No.: US 8,109,800 B2
(45) Date of Patent: Feb. 7, 2012

(54) OUTBOARD MOTOR

(75) Inventors: Yoshihiko Okabe, Shizuoka (JP); Hirotoshi Yamauchi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 468 days.

(21) Appl. No.: 12/365,957

(22) Filed: Feb. 5, 2009

(65) Prior Publication Data

US 2009/0203271 A1 Aug. 13, 2009

(30) Foreign Application Priority Data

Feb. 8, 2008 (JP) ..... 2008-028853

(51) Int. Cl.
*B63H 20/14* (2006.01)

(52) U.S. Cl. ..... 440/75

(58) Field of Classification Search ..... 440/75
See application file for complete search history.

(56) References Cited

U.S. PATENT DOCUMENTS 4,323,354 A * 4/1982 Blanchard ..... 440/75
4,331,432 A * 5/1982 Blanchard ..... 440/75

FOREIGN PATENT DOCUMENTS

EP 1 902 943 A1 3/2008
WO 2007/007707 A1 1/2007

* cited by examiner

*Primary Examiner* — Edwin Swinehart
(74) *Attorney, Agent, or Firm* — Keating & Bennett, LLP

(57) ABSTRACT

A transmission device includes hydraulic type transmission mechanisms arranged to change the speed or the direction of rotation of an engine, and hydraulic pressure control valves arranged to control hydraulic pressure supplied to the hydraulic type transmission mechanisms. The hydraulic pressure control valves are disposed on one side or the other side in the watercraft width direction. The transmission device provides an outboard motor capable of securing cooling characteristics of a hydraulic pressure control valve without incurring complexity in structure and increase in cost.

9 Claims, 9 Drawing Sheets

OUTBOARD MOTOR

BACKGROUND OF THE INVENTION

1. Field of the Invention

The present invention relates to an outboard motor including a transmission device arranged to change the speed or the direction of rotation of an engine and to transmit the rotation to a propeller.

2. Description of the Related Art

WO 2007-007707 A1 proposes an outboard motor including a hydraulic clutch type transmission mechanism that shifts the speed of rotation of an engine between high speed and low speed positions and transmits the rotation to a propeller, an oil pump for supplying hydraulic pressure to the hydraulic clutch type transmission mechanism, and a hydraulic pressure control valve for controlling hydraulic pressure supplied to the hydraulic clutch type transmission mechanism. A solenoid type hydraulic pressure control valve in which an electromagnetic coil is energized to open or close a valve body is generally applied to the hydraulic pressure control valve.

However, when the solenoid type hydraulic pressure control valve is applied, it is necessary to cool the valve at a position that depends on where the valve is located because the hydraulic pressure control valve generates heat. In this case, if the hydraulic pressure control valve is constructed to be cooled by a separate cooling mechanism, it results in a complicated construction and a cost increase.

Depending on how the hydraulic pressure control valve is arranged, there is concern that the outboard motor may increase in size and the distance from the center of gravity of the outboard motor to a hull may increase, thereby increasing an applied load on a clamp bracket supporting the outboard motor on the hull.

SUMMARY OF THE INVENTION

In order to overcome the problems described above, preferred embodiments of the present invention provide an outboard motor capable of ensuring a cooling characteristic of a hydraulic pressure control valve without causing structural complexity and an increase in cost and without increasing the size of the outboard motor and the load applied to a clamp bracket.

A first preferred embodiment of the present invention provides an outboard motor including an engine arranged to generate power, and a transmission device arranged to change the speed of rotation of the engine and to transmit the rotation to a propeller, in which the transmission device includes a hydraulic type transmission mechanism arranged to change a rotational operation of the engine and a hydraulic pressure control valve arranged to control hydraulic pressure supplied to the hydraulic type transmission mechanism, and the hydraulic pressure control valve is disposed on one side in the watercraft width direction.

A second preferred embodiment of the present invention provides the outboard motor in accordance with the first preferred embodiment, in which the hydraulic pressure control valve is arranged to protrude in a direction toward the one side of the watercraft.

A third preferred embodiment of the present invention provides the outboard motor in accordance with the second preferred embodiment, in which a transmission housing arranged to house the hydraulic type transmission mechanism includes upper and lower housings connected by a fastening bolt, for example, and the hydraulic pressure control valve protrudes in the direction toward the one side in the rear of the fastening bolt disposed on a front side in the watercraft in a fore-and-aft direction.

A fourth preferred embodiment of the present invention provides the outboard motor in accordance with the first preferred embodiment, in which a hydraulic housing arranged to house the hydraulic pressure control valve is detachably mounted on a side wall of a transmission housing arranged to house the hydraulic type transmission mechanism, and at least a portion of a hydraulic circuit is arranged on a mating surface between the side wall of the transmission housing and the hydraulic housing.

A fifth preferred embodiment of the present invention provides the outboard motor in accordance with the fourth preferred embodiment, in which at least a portion of a cooling circuit arranged to cool the hydraulic pressure control valve by oil injection is arranged on the mating surface between the side wall of the transmission housing and the hydraulic housing.

A sixth preferred embodiment of the present invention provides the outboard motor in accordance with the first preferred embodiment, in which the hydraulic pressure control valve is disposed with its valve shaft oriented in the watercraft fore-and-aft direction, and an input passage and an output passage of hydraulic pressure to and from the hydraulic pressure control valve are arranged to extend in directions perpendicular, or substantially perpendicular, to the valve shaft.

A seventh preferred embodiment of the present invention provides the outboard motor in accordance with the first preferred embodiment, in which the hydraulic pressure control valve is disposed above a lower mount member arranged to support the outboard motor.

An eighth preferred embodiment of the present invention provides the outboard motor in accordance with the seventh preferred embodiment, in which the hydraulic pressure control valve is disposed to protrude in a direction toward the one side, a level to which the hydraulic pressure control valve protrudes in the direction toward the one side is equivalent, or substantially equivalent, to a level to which the lower mount member protrudes in the direction toward the one side.

The hydraulic pressure control valve is disposed on one side in the watercraft width direction in the outboard motor in accordance with the first preferred embodiment of the present invention. This facilitates contact between a headwind and the hydraulic pressure control valve during traveling, thus ensuring the cooling characteristics of the hydraulic pressure control valve. As a result, it is not necessary to provide a separate cooling mechanism, thus preventing a complex structure and an increase in cost.

Because the hydraulic pressure control valve is disposed on one side in the watercraft width direction, it allows for the prevention of an increase in the size of the outboard motor in the fore-and-aft direction due to a disposition of the hydraulic pressure control valve. As a result, it prevents both a size increase of the outboard motor and an increase in the load applied to the clamp bracket.

In the second preferred embodiment of the present invention, the hydraulic pressure control valve is arranged to protrude in a direction toward one side. This facilitates contact between a headwind and the hydraulic pressure control valve during traveling, thus enhancing the cooling characteristics.

In the third preferred embodiment of the present invention, the hydraulic pressure control valve protrudes in the direction toward one side in the rear of the fastening bolt disposed on the front side in the watercraft fore-and-aft direction. Therefore, a cover arranged to cover the hydraulic pressure control valve is prevented from contacting with the clamp bracket and so forth when the outboard motor is steered to a maximum steering angle. As a result, both a size increase of the outboard motor and an increase in the load applied on the bracket can be prevented while also securing sufficient steering angles.

In the fourth preferred embodiment of the present invention, at least a portion of the hydraulic circuit is arranged on the mating surface between the transmission housing and the hydraulic housing. This allows for a downsizing of the hydraulic circuit by utilizing the mating surface between both the housings and facilitates forming the hydraulic circuit.

In the fifth preferred embodiment of the present invention, at least a portion of the cooling circuit arranged to cool the hydraulic pressure control valve is arranged on the mating surface between the transmission housing and the hydraulic housing. Therefore, the hydraulic pressure control valve can be cooled by both a headwind and oil, thus achieving an improvement in the cooling rate and a further improvement in the durability of the hydraulic pressure control valve.

In the sixth preferred embodiment of the present invention, the valve shaft of the hydraulic pressure control valve is disposed in the watercraft fore-and-aft direction, and the input passage and the output passage between the hydraulic pressure control valve are arranged in the directions perpendicular, or substantially perpendicular, to the valve shaft. Therefore, hydraulic pressure can come and go directly between the hydraulic pressure control valve and the transmission mechanism, thus achieving a simple configuration of the hydraulic circuit and savings in cost.

In the seventh preferred embodiment of the present invention, the hydraulic pressure control valve is disposed above the lower mount member. Therefore, the hydraulic pressure control valve can be disposed without interfering with the lower mount member. Further, the whole outboard motor can be arranged compactly.

In the eighth preferred embodiment of the present invention, the level to which the hydraulic pressure control valve protrudes on the side is equivalent, or substantially equivalent, to the level to which the lower mount member protrudes on the side. Therefore, the hydraulic pressure control valve does not protrude higher than the lower mount member that is originally installed. Thus, a size increase of the outboard motor can also be prevented in this manner.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
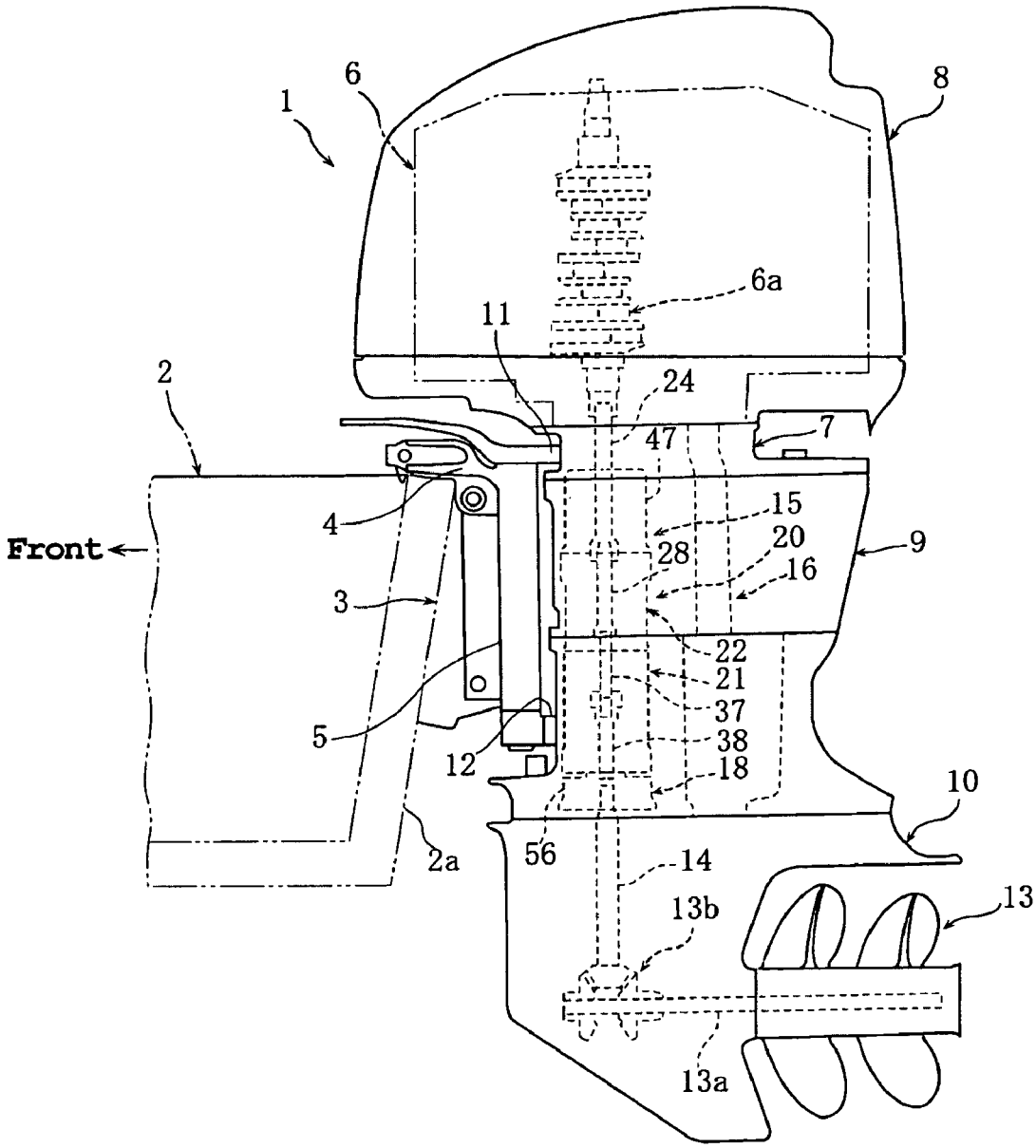
FIG. 1 is a side view of an outboard motor including a transmission device in accordance with a preferred embodiment of the present invention.

Preferred embodiments of the present invention will now be described hereinafter with reference to the attached drawings.

FIGS. 1 through 9 are drawings for describing an outboard motor in accordance with preferred embodiments of the present invention. Front, rear, right, and left in descriptions of the preferred embodiments denote front, rear, right, and left in the view as seen from the rear of a watercraft unless otherwise specified.

In the figures, reference numeral 1 denotes an outboard motor installed at a stern 2*a* of a hull 2. The outboard motor 1 is supported swingably in the vertical direction by a clamp bracket 3 fixed to the hull 2 via a swivel arm 4 and supported to be steerable to the right and left via a pivot portion 5.

The outboard motor 1 has an engine 6 in which a crankshaft 6*a* is oriented generally vertically, an exhaust guide 7 on which the engine 6 is mounted, a cowling 8 connected to an upper surface of the exhaust guide 7 to cover an outer periphery of the engine 6, an upper case 9 connected to a lower surface of the exhaust guide 7, and a lower case 10 connected to a lower surface of the upper case 9.

The outboard motor 1 is supported by the clamp bracket 3 via an upper mount member 11 mounted on the exhaust guide 7 and a lower mount member 12 mounted on a lower end of the upper case 9.

The outboard motor 1 includes the engine 6 arranged to generate power and a transmission device 15 arranged to change the speed of rotation of the engine 6 and to transmit the rotation to a propeller 13.

The transmission device 15 includes a first input shaft 24 connected to the crankshaft 6*a* arranged to output power of the engine 6, a hydraulic type and planetary gear type transmission mechanism 20 connected to the first input shaft 24 and arranged to change the speed of rotation of the engine 6, and a hydraulic type forward-reverse switching mechanism 21 connected to the transmission device 20 and arranged to change the direction of rotation of the engine 6.

The propeller 13 is attached to a propeller shaft 13*a*. The propeller shaft 13*a* is connected to a drive shaft 14 via a bevel gear mechanism 13*b*. The propeller shaft 13*a* is disposed in a direction perpendicular, or substantially perpendicular, to the crankshaft 6*a* in the lower case 10. The drive shaft 14 is coaxially disposed with the crankshaft 6*a*.

The transmission mechanism 15 is housed in a generally cylindrical transmission housing 22 that is preferably oil-tight. The transmission housing 22 is housed in the upper case 9 to be positioned in a front portion thereof. An exhaust system 16 arranged to discharge exhaust gas from the lower case 10 into the water is disposed in the rear of the transmission device 15 in the upper case 9.

The transmission housing 22 is divided into an upper housing 22*a* in which the transmission mechanism 20 is housed and a lower housing 22*b* in which the forward-reverse switching mechanism 21 is housed. The lower housing 22*b* and the upper housing 22*a* are combined together preferably by front bolts B1, for example, disposed on the left and right sides on the front side in the watercraft fore-and-aft direction and preferably by rear bolts B2, for example, disposed on the left and right sides on the rear side (see FIG. 5).

The planetary gear type transmission mechanism 20 preferably includes a first internal gear 25, a first sun gear 27, a first output shaft 28, a first carrier 29, first planetary gears 30, and a second clutch 31.

The first internal gear 25 is connected to the first input shaft 24 to rotate together therewith. The first sun gear 27 is connected toward the housing 22 via a first clutch 26. The first output shaft 28 is coaxially disposed with the first input shaft 24. The first carrier 29 is connected to the first output shaft 28 to rotate together therewith. The first planetary gears 30 are supported by the first carrier 29 to be capable of relative rotation and are meshed with the first sun gear 27 and the first internal gear 25. The second clutch 31 is located between the first sun gear 27 and the first carrier 29.

The first input shaft 24 is coaxially disposed with the crankshaft 6*a* and combined with the crankshaft 6*a* to rotate together therewith.

The first sun gear 27 is fixedly housed in or rotatably supported by the housing 22. The first sun gear 27 is connected to or disconnected from a support housing 33 for rotatably supporting the first output shaft 28 via the first clutch 26.

Figure 5:
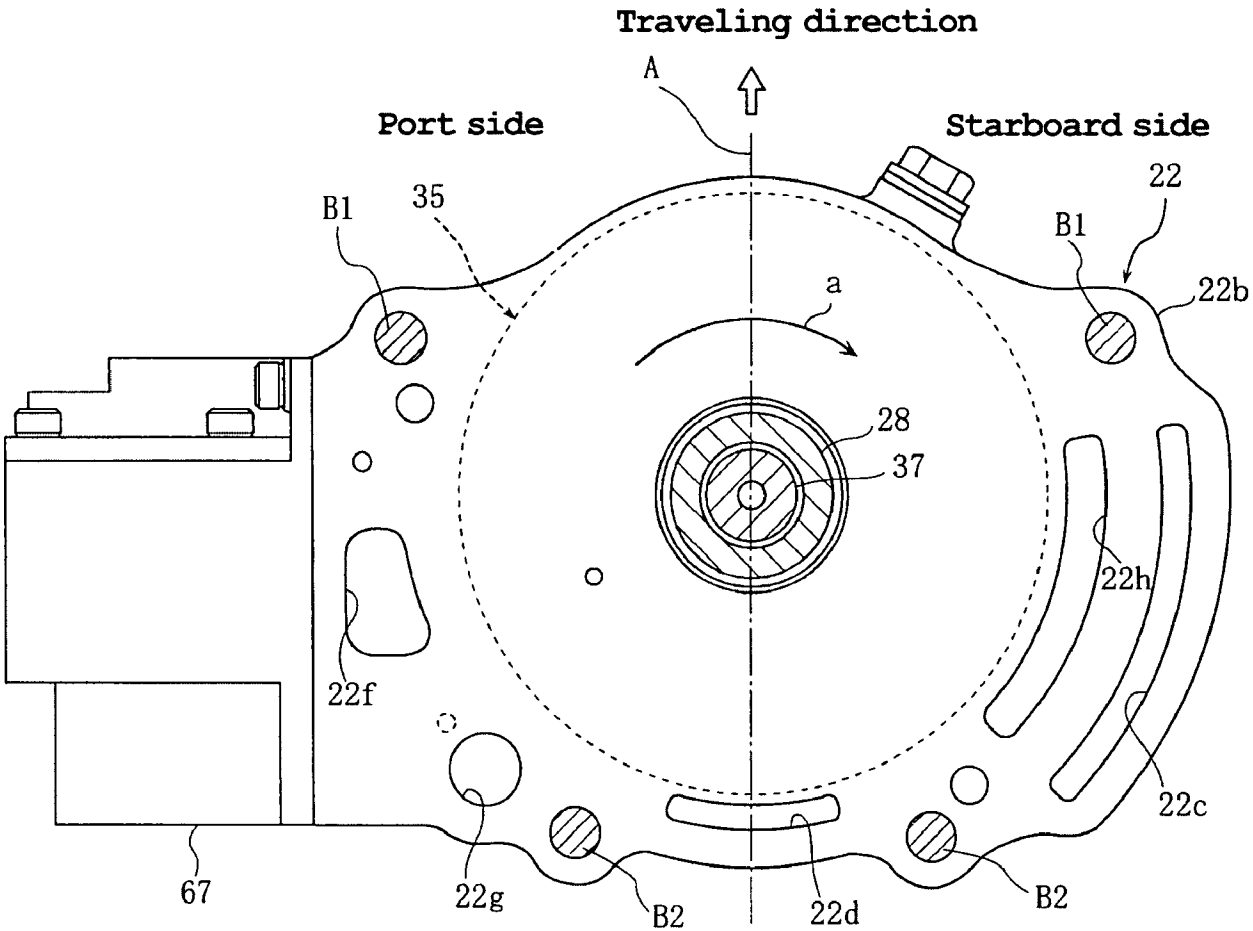
FIG. 5 is a cross-sectional view taken along line V-V in FIG. 2.
Figure 6:
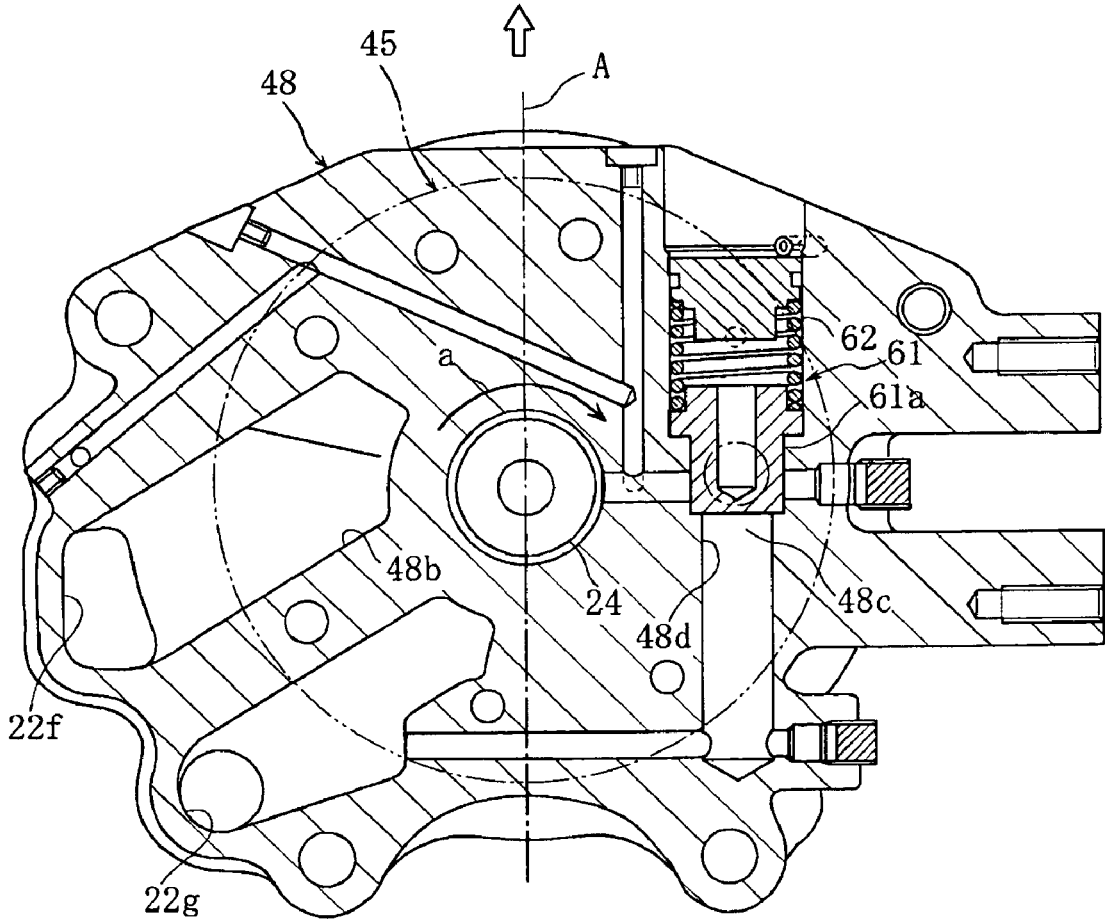
FIG. 6 is a cross-sectional view taken along line VI-VI in FIG. 2.

As shown in FIG. 5, the first clutch 26 is a one-way type clutch which permits only rotation of the first sun gear 27 in rotational direction (a) (clockwise) of the crankshaft 6*a* but prohibits rotation in the opposite direction (counterclockwise).

The second clutch 31 is preferably a wet type multi-plate clutch and has a clutch housing 31*a* combined with the first sun gear 27 to rotate together therewith, a number of clutch plates 31*b* disposed between the clutch housing 31*a* and the first carrier 29, a piston 31*e* disposed in a hydraulic chamber 31*d* arranged in the clutch housing 31*a*, and a spring member 31*c* urging the piston 31*e* in a direction to disconnect power transmission. The piston 31*e* brings the clutch plates 31*b* into contact with each other by hydraulic pressure supplied to the hydraulic chamber 31*d*.

When an operator of the watercraft operates a shift lever or a shift button (neither shown) to a low speed position, the first clutch 26 is engaged, the first sun gear 27 is locked, and the second clutch 31 is disengaged. When rotation of the engine 6 is transmitted from the first input shaft 24 to the first internal gear 25 in this state and the internal gear 25 rotates, each of the planetary gears 30 rotates, rotates relatively to the first internal gear 25, and revolves with respect to the first sun gear 27. Thereby, the speed of engine rotation is reduced and the rotation is transmitted to the first output shaft 28.

On the other hand, when operation is changed to a high speed position, the first clutch 26 is disengaged, the first sun gear 27 enters a free state, and the second clutch 31 is engaged. When rotation of the engine 6 is transmitted from the first input shaft 24 to the first internal gear 25 in this state, the first internal gear 25, each of the first planetary gears 30, and the first sun gear 27 rotate unitarily. Rotation of the first input shaft 24 is transmitted to the first output shaft 28 without speed reduction.

The forward-reverse switching mechanism 21 has a second internal gear 36, a second input shaft 37, a second output shaft 38, a second sun gear 39, a second carrier 40, a second planetary gear 41, a third planetary gear 42, and a fourth clutch 43.

The internal gear 36 is connected to the housing 22 via a third clutch 35. The second input shaft 37 is coaxially disposed with the first output shaft 28 and connected to the first output shaft 28 to rotate together therewith. The second output shaft 38 is coaxially disposed with the second input shaft 37. The second sun gear 39 is unitarily disposed with and connected to the second output shaft 38. The second carrier 40 is connected to the second input shaft 37 to rotate together therewith. The second planetary gear 41 is rotatably supported by the second carrier 40 and meshed with the second sun gear 39. The third planetary gear 42 is meshed with the second internal gear 36. The fourth clutch 43 is installed between the second carrier 40 and the second output shaft 38.

The fourth clutch 43 and the third clutch 35 are preferably multi-plate wet type clutches having constructions similar to the second clutch 31 described above.

When a shift lever or a shift switch (neither shown) arranged to switch between forward and reverse is in a neutral position, the third and fourth clutches 35 and 43 are disengaged. The second input shaft 37 idles. Accordingly, rotation of the second input shaft 37 is not transmitted to the second output shaft 38.

When shifting from the neutral position to a forward position, the third clutch 35 is disengaged, and the fourth clutch 43 is engaged. The second internal gear 36, the second and third planetary gears 41 and 42, and the second sun gear 39 rotate unitarily. The second output shaft 38 rotates in the forward travel direction which is the same as rotational direction (a) of the engine 6.

On the other hand, when shifting from the neutral position to a reverse position, the third clutch 35 is engaged, and the fourth clutch 43 is disengaged. The second internal gear 36 is fixed to the housing 22 to be unable to rotate. The second and third planetary gears 41 and 42 revolve while rotating in directions opposite to each other. The second sun gear 39 rotates in the opposite direction. Thereby, the second output shaft 38 rotates in the reverse travel direction which is the direction opposite to rotational direction (a) of the crankshaft 6*a*.

The transmission device 15 preferably has a planetary gear type speed reducing mechanism 18 arranged to reduce the speed of rotation of the second output shaft 38 and transmit the rotation to the drive shaft 14.

The planetary gear type speed reducing mechanism 18 has an internal gear 55, a planetary gear 57, and a sun gear 58.

The internal gear 55 is connected to the second output shaft 38 to rotate together therewith. The planetary gear 57 is meshed with the internal gear 55 and rolls on the internal gear 55. The sun gear 58 is meshed with the planetary gear 57 and disposed to be unable to rotate.

The speed reducing mechanism 18 has a speed reducer housing 56 fixed to the lower case 10 and rotatably supporting a boss 55*a* of the internal gear 55 and a carrier 59 rotatably supporting the planetary gear 57.

The sun gear 58 is fixed to the lower case 10 to be incapable of rotation. The carrier 59 is rotatably supported by the sun gear 58. The carrier 59 is combined with the drive shaft 14 to rotate together therewith.

The transmission device 15 includes the first input shaft 24 constructing the power transmitting portion, an oil pump 45 disposed on the first input shaft 24, and a driving force acquisition mechanism 46 arranged to acquire driving force from the first input shaft 24.

The oil pump 45 supplies hydraulic pressure to the second through fourth clutches 31, 35, and 43 and supplies oil for lubricating and cooling each slide portion of the transmission device 15. The oil pump 45 is independent from an oil pump arranged to supply lubricating oil to each sliding portion of the crankshaft 6*a* and so forth of the engine 6.

The first input shaft 24 extends upward from the housing 22 and is housed in a first housing 47 connected to an upper surface of the housing 22. A second housing 48 arranged to house the oil pump 45 is disposed in and fixed to the first housing 47. The first input shaft 24 is rotatably supported by the second housing 48.

A third housing 49 arranged to house the driving force acquisition mechanism 46 is connected to the outside of the first housing 47. The third housing 49 is disposed to extend outward on the starboard side of the first housing 47 in the watercraft width direction.

The driving force acquisition mechanism 46 has a driving force acquisition shaft 46*a* extending in a direction toward the starboard side and perpendicular, or substantially perpendicular, to the axis of the first input shaft 24. The driving force acquisition shaft 46*a* is connected to the first input shaft 24 to rotate together therewith via a bevel gear mechanism 46*b*.

A water pump 50 is connected to the driving force acquisition mechanism 46. The water pump 50 has a pump shaft 52 disposed in the third housing 49 in parallel, or substantially parallel, with the driving force acquisition shaft 46*a* and on which a reduction gear 52*a* meshed with a driving gear 46*c* of the driving force acquisition shaft 46*a* is arranged and a pump cover 51 arranged to house the water pump 50. The pump cover 51 is detachably connected to the third housing 49.

A portion of coolant drawn up by the water pump 50 is supplied to the engine 6 side by a coolant hose 51*a* connected to the pump cover 51. The remaining coolant is supplied to the transmission device 15 side by a branch hose 51*b* connected to the coolant hose 51*a*.

Coolant jackets 22*c* and 22*d* extending in the circumferential direction are arranged on the starboard and the rear sides of the housing 22. The branch hose 51*b* is connected to the coolant jackets 22*c* and 22*d*.

The oil pump 45 has an inner rotor 45*a* housed in a pump chamber 48*a* arranged in the second housing 48 and combined with the first input shaft 24 to rotate together therewith and an outer rotor 45*b* fixed to the second housing 48. The oil pump 45 pressurizes and discharges oil drawn by rotation of the inner rotor 45*a*.

An oil inlet 48*b* fluidly connected to a suction port of the oil pump 45 and an oil outlet 48*c* fluidly connected to a discharge port are defined in the second housing 48.

An oil reservoir 22*e* is arranged at a bottom of the housing 22. The oil reservoir 22*e* and the oil inlet 48*b* are fluidly connected together by an oil drawing passage 22*f* provided in the housing 22 and extending in the axial direction.

An oil discharge passage 22*g* extending in parallel, or substantially parallel, with the oil drawing passage 22*f* is provided in the housing 22. An upstream end of the oil discharge passage 22*g* is fluidly connected to the oil outlet 48*c*. A downstream end thereof is fluidly connected to hydraulic chambers 31*d*, 35*d*, and 43*d* of the second through fourth clutches 31, 35, and 43 via respective clutch hydraulic passages 22*i*.

The oil drawing passage 22*f* and the discharge passage 22*g* are disposed on the port side in the watercraft width direction with respect to a straight line "A" extending in the traveling direction through the center of the first input shaft 24 (shown in FIG. 5). In addition, the oil drawing passage 22*f* is disposed in a portion downstream of the oil discharge passage 22*g* in rotational direction (a) of the crankshaft 6*a* (on the front side in the watercraft traveling direction).

An oil return passage 22*h* extending in the circumferential direction along the inside of the coolant jacket 22*c* is arranged on the side generally opposite to the oil drawing passage 22*f* across the second input shaft 37 in the lower housing 22*b*. The oil return passage 22*h* is fluidly connected to the oil reservoir 22*e*.

Oil passages 24*a*, 28*a*, 37*a*, and 38*a* are arranged to be fluidly connected to each other in the axes of the first input shaft 24, the first output shaft 28, the second input shaft 37, and the second output shaft 38, respectively. Oil supplied from the oil outlet 48*c* to the oil passages 24*a*, 28*a*, 37*a*, and 38*a* is supplied to each of bearings, slide parts, and so forth.

In this case, oil supplied into the upper housing 22*a* returns to the oil reservoir 22*e* through the oil return passage 22*h* of the lower housing 22*b*. Oil supplied into the lower housing 22*b* drops and returns to the oil reservoir 22*e*.

A relief passage 48*d* fluidly connecting the oil discharge passage 22*g* and the oil drawing passage 22*f* together is defined in the second housing 48. A relief valve 61 is interposed in the relief passage 48*d*. A valve body 61*a* is urged in the closing direction by a spring member 62 in the relief valve 61. An elastic force of the spring member 62 is set so that a valve body 61*a* opens when pressure in the relief passage 48*d* exceeds a predetermined value (see FIG. 6).

The transmission device 15 includes second through fourth hydraulic pressure control valves 65, 66, and 67 arranged to control hydraulic pressure supplied to the second through fourth clutches 31, 35, and 43, respectively, of the planetary gear type transmission mechanism 20 and the forward-reverse switching mechanism 21 independently of each other.

Each of the second through fourth hydraulic pressure control valves 65 through 67 is controlled by a controller (not shown) to open or close based on a speed shifting signal, a forward-reverse switching signal, and so forth.

The hydraulic pressure control valves 65 through 67 are housed in respective hydraulic housing 65*a* through 67*a* arranged independently of each other. The hydraulic housing 65*a* through 67*a* have respective housing main bodies 65*b* through 67*b* detachably mounted on a left side wall surface 22*k* of the housing 22 by a plurality of bolts 68 inserted from the outside and respective lid members 65*c* through 67*c* detachably mounted on the housing main bodies 65*b* through 67*b* in a state that the hydraulic pressure control valves 65 through 67 are preferably fixed by a plurality of bolts 69, for example, inserted from the front side.

Each of the hydraulic pressure control valves 65 through 67 is disposed in parallel, or substantially parallel, in the vertical direction on the port side in the watercraft width direction of the housing 22 and is disposed to protrude outward from the housing 22 in the watercraft width direction.

The hydraulic pressure control valves 65 through 67 protrudes toward the port side in a portion between the front bolt B1 and the rear bolt B2 on the left side arranged to combine the upper housing 22*a* and the lower housing 22*b* together. The front bolts B1 preferably arranged to fasten the upper and lower housings 22*a* and 22*b* together are designed so that an outer surface of a portion of the upper case 9 covering the bolts do not contact with the clamp bracket and so forth at the maximum steering angles. The hydraulic pressure control valves 65 through 67 protrude toward the port side in the rear of the front bolt B1. Therefore, a portion 9*a* of the upper case 9 covering the hydraulic pressure control valves 65 through 67 can be prevented from contacting with the clamp bracket and so forth when the outboard motor is turned to the maximum steering angle.

Figure 2:
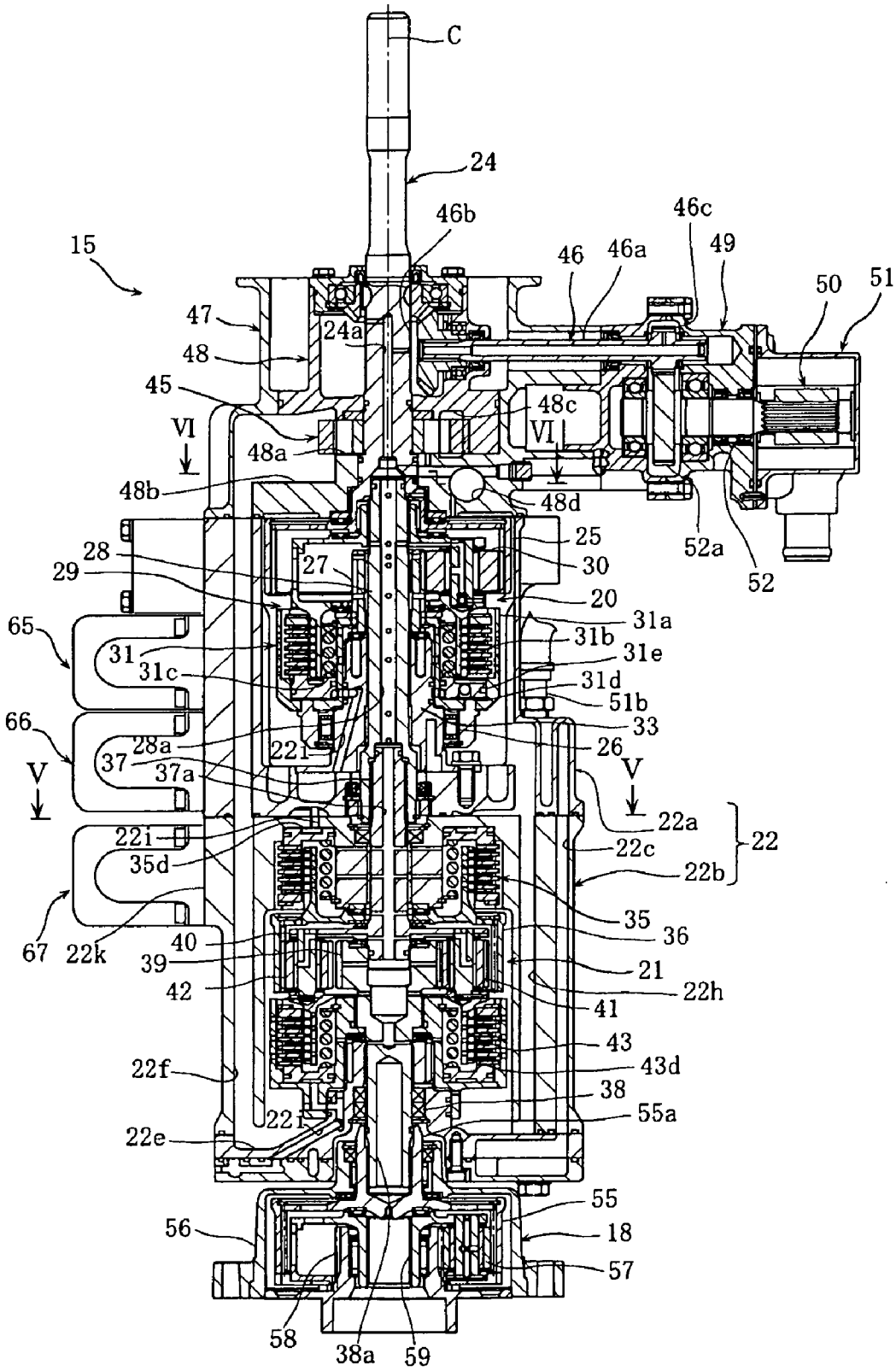
FIG. 2 is across-sectional rearview of a transmission device in accordance with a preferred embodiment of the present invention.
Figure 3:
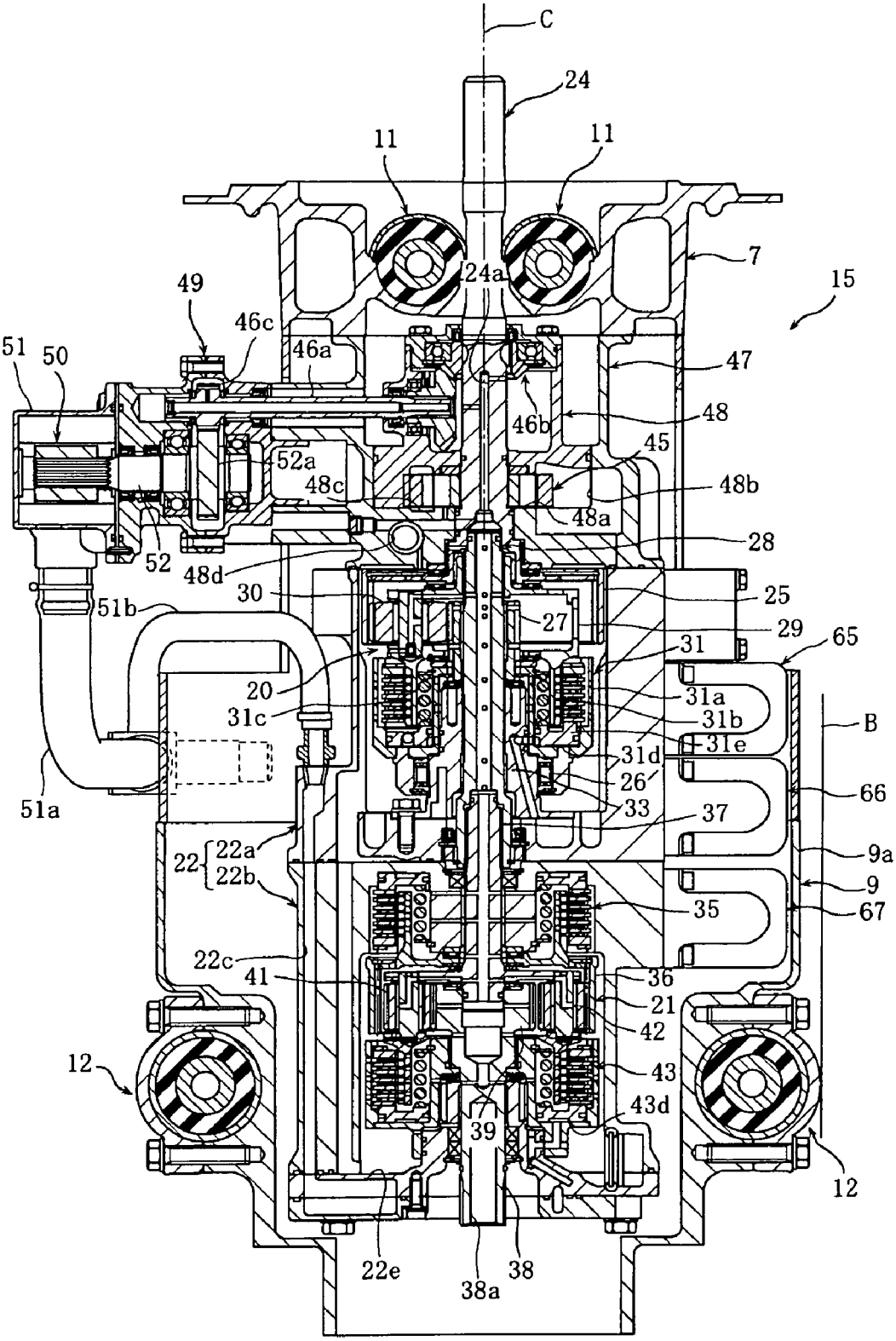
FIG. 3 is a cross-sectional front view of a transmission device in accordance with a preferred embodiment of the present invention.
Figure 4:
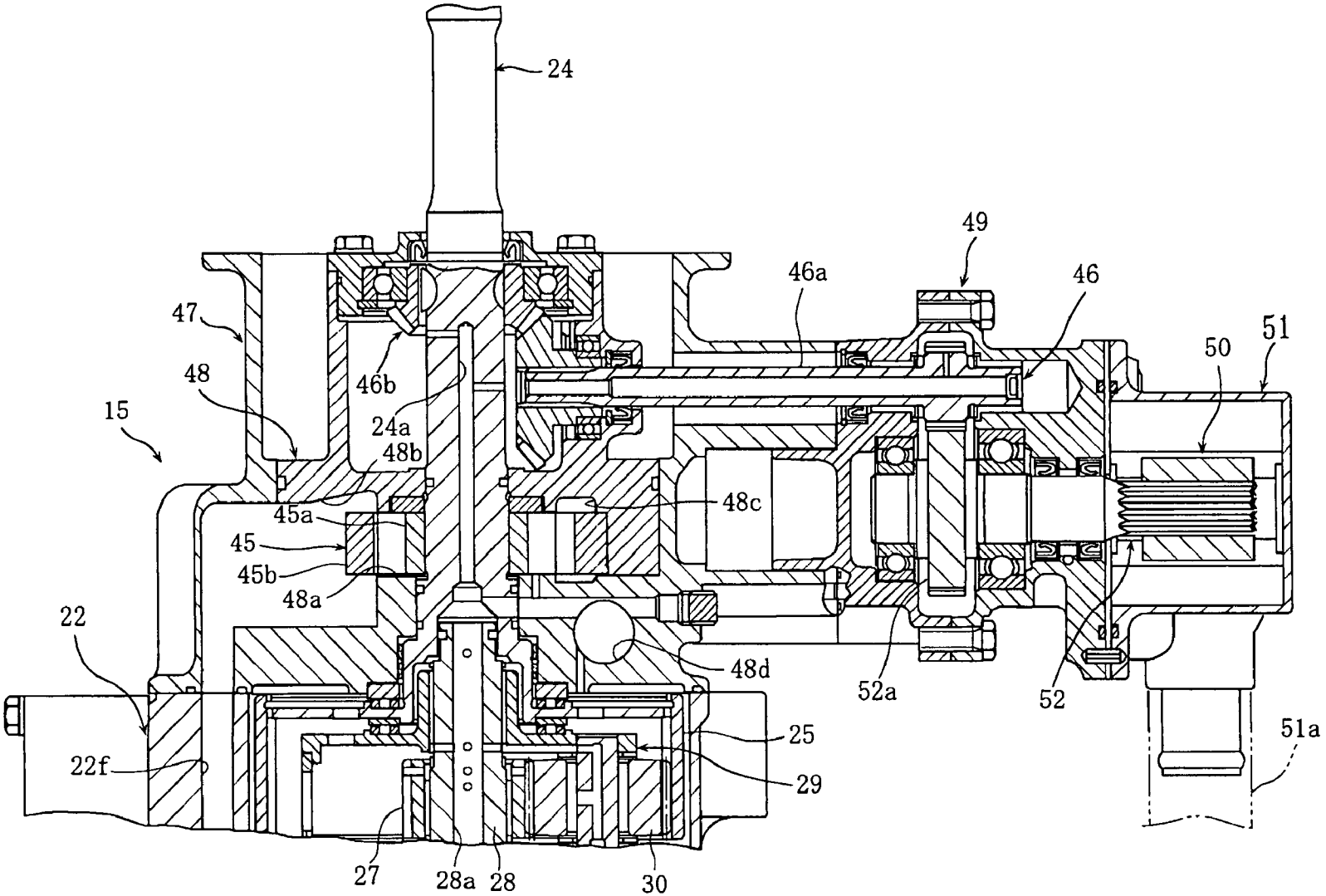
FIG. 4 is a cross-sectional view of a power transmitting portion in which an oil pump of a transmission device in accordance with a preferred embodiment of the present invention is disposed.

Each of the hydraulic pressure control valves 65 through 67 is disposed on the side opposite to the water pump 50 across the center line C of the transmission device and is positioned below the water pump 50 in a view from the rear of the watercraft (see FIG. 2). This stabilizes the weight balance between the left and the right sides of the transmission device 15.

Each of the hydraulic pressure control valves 65 through 67 is positioned above the lower mount member 12 in a view from a side of the watercraft. A level to which each of the hydraulic pressure control valves 65 through 67 protrudes toward the port side is substantially equivalent to a level to which the lower mount member 12 protrudes toward the port side (see straight line B in FIG. 3).

Figure 7:
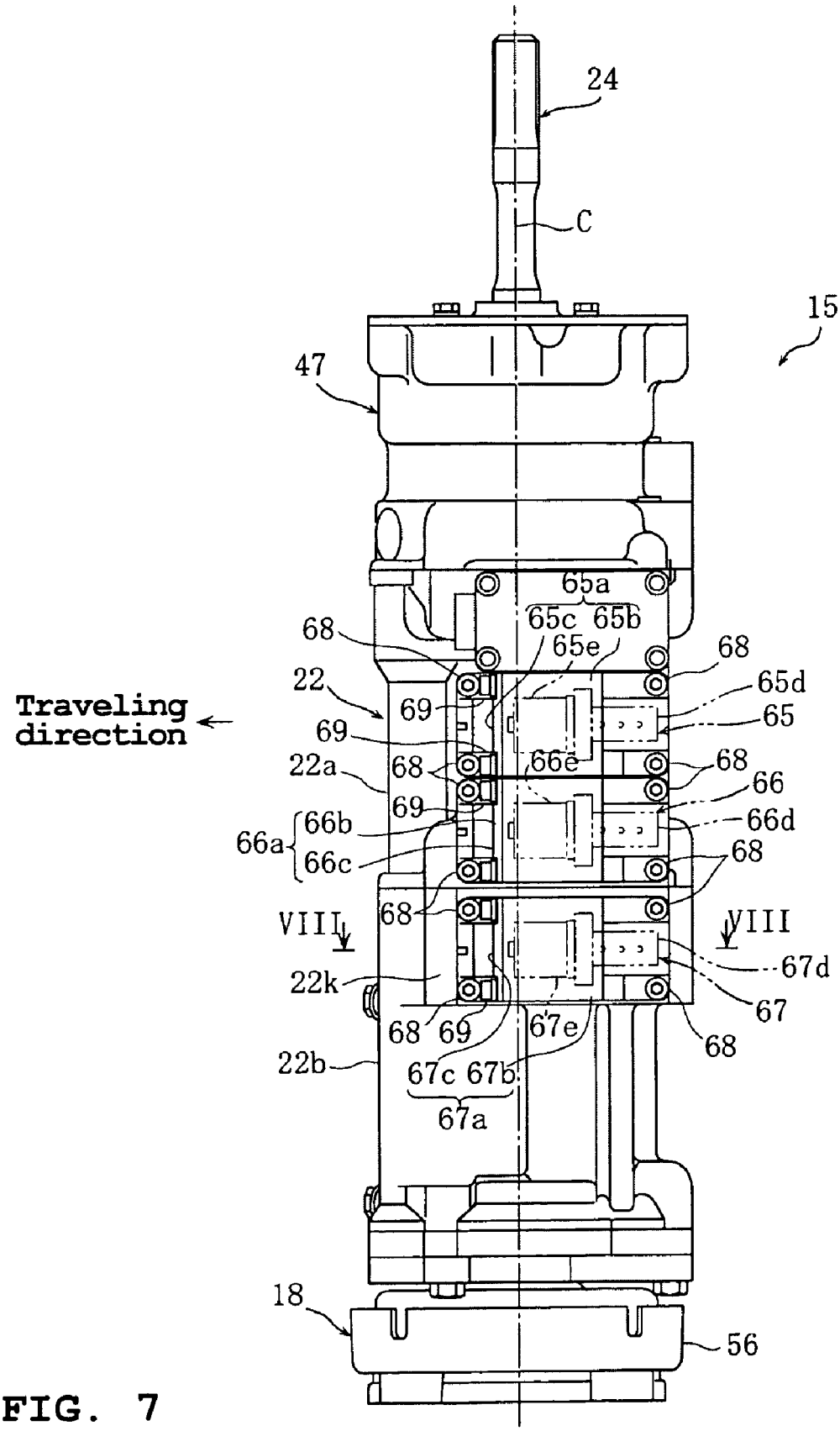
FIG. 7 is a side view of a housing in which a transmission device in accordance with a preferred embodiment of the present invention is housed.

The hydraulic pressure control valves 65 through 67 have respective valve shafts 65*d* through 67*d* whose axes are disposed in the fore-and-aft direction that is the watercraft traveling direction and respective electric drivers 65*e* through 67*e* connected to front sides of the respective valve shafts 65*d* through 67*d* and reciprocally driving the valve shafts 65*d* through 67*d* in the axial directions (shown in FIG. 7).

Figure 8:
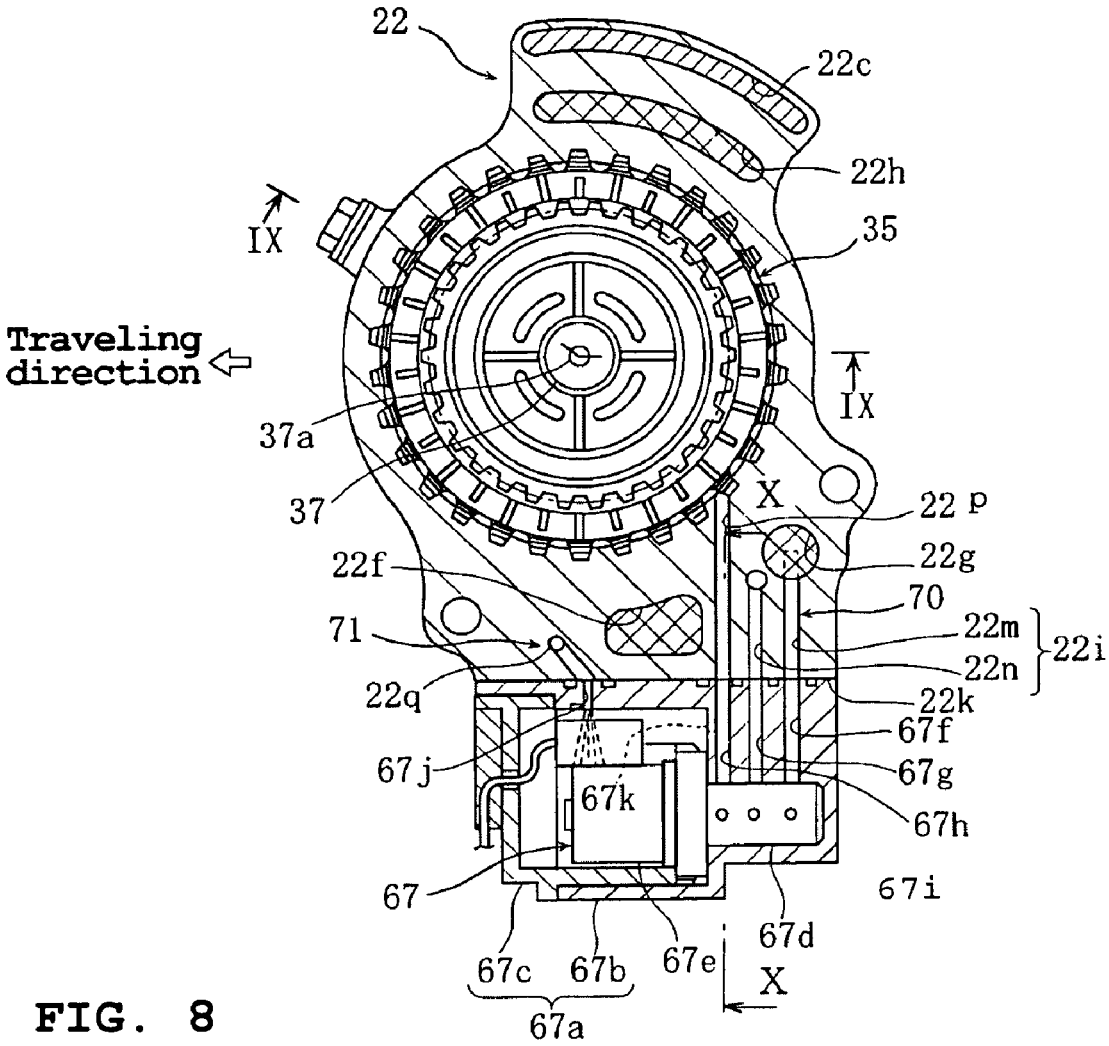
FIG. 8 is a cross-sectional view taken along line VIII-VIII in FIG. 7.
Figure 9:
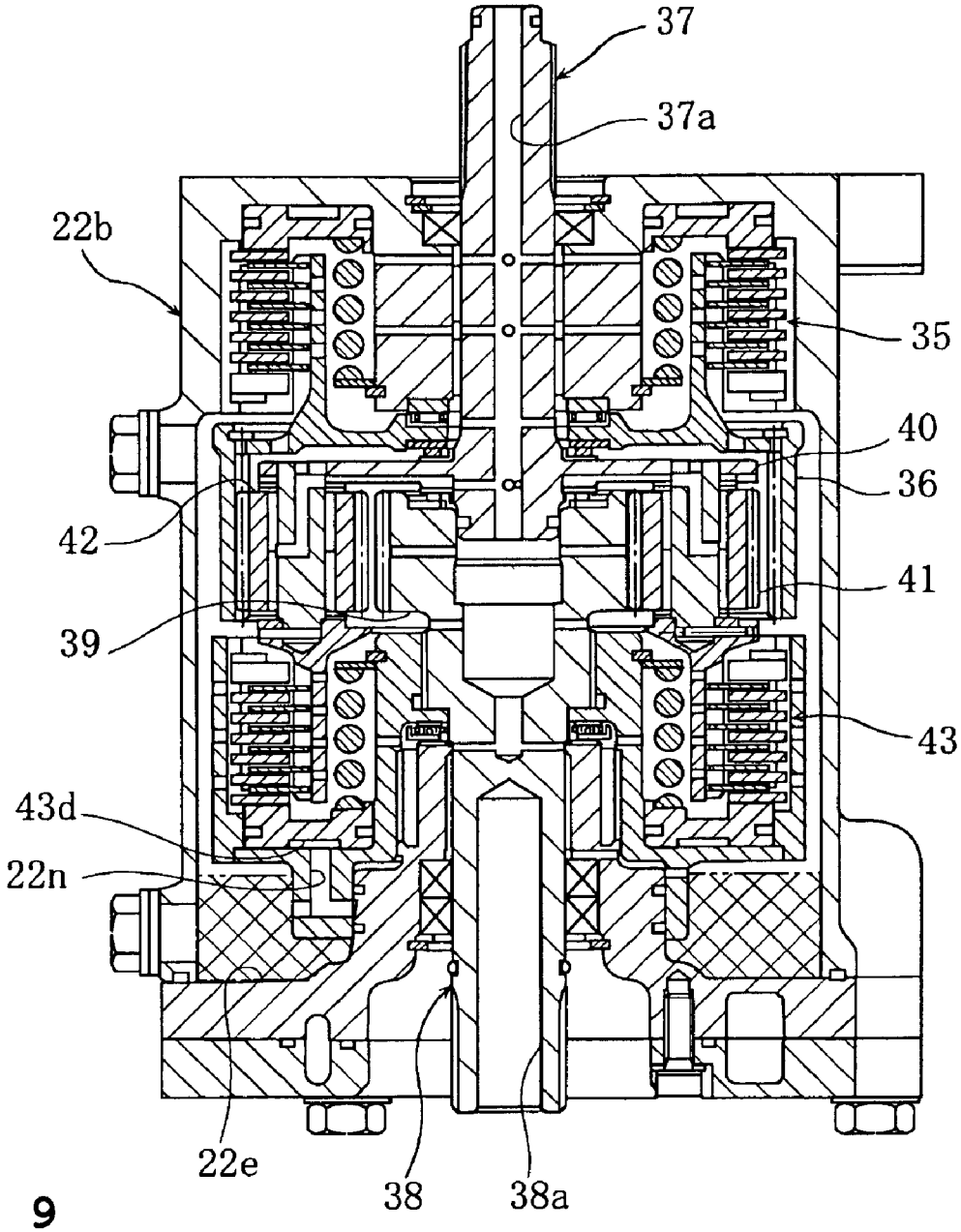
FIG. 9 is a cross-sectional view taken along line IX-IX in FIG. 8.

A hydraulic circuit 70 and a cooling circuit 71 are arranged on a mating surface between the left side wall surface 22*k* of the housing 22 and each of the hydraulic housings 65*a* through 67*a*. Here, since the hydraulic circuits 70 and the cooling circuits 71 of the second through fourth hydraulic pressure control valves 65 through 67 have similar constructions, descriptions will be made only about the hydraulic circuit 70 and the cooling circuit 71 of the fourth hydraulic pressure control valve 67 for controlling hydraulic pressure supplied to the fourth clutch 43, that are shown in FIG. 8.

The cooling circuit 71 is arranged to cool the hydraulic pressure control valve 67 through the injection of oil. Specifically, hydraulic cooling passages 22*q* and 67*j* fluidly connected to the oil discharge passage 22*g* are arranged to extend in the watercraft width direction in the housing 22 and the hydraulic housing 67*a*. The hydraulic cooling passage 67*j* opens toward the driver 67*e* in the hydraulic housing 67*a*.

Oil pressurized by the oil pump 45 passes through the oil discharge passage 22*g* and the hydraulic cooling passages 22*q* and 67*j* and is injected to the driver 67*e*, thereby cooling the driver 67*e*. Oil injected to the driver 67*e* returns into the housing 22 via a return passage 67*k* and a return hole 67*i* arranged in the hydraulic housing 67*a*.

The hydraulic circuit 70 is constructed to disconnect or connect hydraulic pressure to the fourth clutch 43 and specifically has the following construction.

The clutch hydraulic passage 22*i* arranged in the housing 22 is bifurcated into a hydraulic pressure input passage 22*m* fluidly connected to the oil discharge passage 22*g* and a hydraulic pressure output passage 22*n* fluidly connected to the hydraulic chamber 43*d* of the fourth clutch 43.

A hydraulic pressure input passage 67*f* fluidly connecting the valve shaft 67*d* of the hydraulic pressure control valve 67 and the hydraulic pressure input passage 22*m* together and a hydraulic pressure output passage 67*g* fluidly connecting the valve shaft 67*d* and the hydraulic pressure output passage 22*n* together are arranged in the hydraulic housing 67*a*.

Hydraulic pressure releasing passages 22*p* and 67*h* arranged to release hydraulic pressure supplied to the hydraulic chamber 43*d* are defined in the housing 22 and the hydraulic housing 67*a*. The hydraulic pressure releasing passage 67*h* is fluidly connected to the housing 22 through the hydraulic pressure releasing passage 22*p*.

The hydraulic pressure input passages 22*m* and 67*f*, the hydraulic pressure output passages 22*n* and 67*g*, and the hydraulic pressure releasing passages 22*p* and 67*h* are arranged to extend in directions perpendicular, or substantially perpendicular, to the axis of the valve shaft 67*d*.

The hydraulic pressure output passages 22*n* and 67*g* and the hydraulic pressure input passages 22*m* and 67*f* are arranged on the rear side of the hydraulic housing 67*a*. Thereby, the oil discharge passage 22*g* and so forth can be disposed in a rear portion of the transmission housing 22.

Hypothetically, if the hydraulic pressure output passages and the hydraulic pressure input passages were arranged on the front side of the hydraulic housing 67*g*, the oil line would be complicated, or it would be required to dispose the oil discharge passage in a front portion of the transmission housing 22. However, if the oil discharge passage were disposed in the front portion, a front portion of the transmission housing 22 would become large, and the second input shaft (i.e., whole outboard motor) would have to be disposed in the rear. This would results in an increase in the load applied on the bracket.

Oil pressurized by the oil pump 45 is supplied to the hydraulic pressure input passages 22*m* and 67*f* through the oil discharge passage 22*g*. The hydraulic pressure input passage 67*f* is blocked by the valve shaft 67*d*. Thereby, the fourth clutch 43 is disengaged.

When the valve shaft 67*d* of the hydraulic pressure control valve 67 moves and the hydraulic pressure input passage 67*f* opens, oil is supplied to the hydraulic chamber 43*d* of the fourth clutch 43 through the hydraulic pressure output passage 67*g*. Thereby, the fourth clutch 43 is engaged. The hydraulic pressure input passage 67*f* is blocked when the valve shaft 67*d* returns to the original position. Hydraulic pressure in the hydraulic chamber 43*d* is released into the hydraulic housing 67*a* through the hydraulic pressure releasing passages 67*h* and 22*p*.

Each of the hydraulic pressure control valves 65 through 67 is preferably disposed on the port side of the transmission housing 22 in the watercraft width direction. This facilitates contact between a headwind and the hydraulic pressure control valves 65 through 67 via the upper case 9 when traveling. Accordingly, the cooling characteristics of the hydraulic pressure control valves 65 through 67 can be secured. As a result, it is not required to separately provide a cooling mechanism, thus preventing complexity in structure and increase in cost.

Each of the hydraulic pressure control valves 65 through 67 is preferably disposed on the port side of the housing 22. Therefore, the control valves can be disposed by utilizing an open space in the upper case 9, thus allowing for a reduction in the size of the transmission device 15 in the fore-and-aft direction. Thereby, the transmission device 15 can be positioned forward. As a result, the center of gravity of the outboard motor 1 can be positioned closer to the hull 2. This allows for a reduction in the load applied on the clamp bracket 3 arranged to support the outboard motor 1 and reduction in the weight and the size of the whole outboard motor.

In the present preferred embodiment, each of the hydraulic pressure control valves 65 through 67 is preferably disposed on the housing 22 to protrude in the direction toward the port side. Therefore, the hydraulic pressure control valves 65 through 67 can be disposed in positions facilitating contact with a headwind when traveling, thus enhancing the cooling characteristics of each of the hydraulic pressure control valves 65 through 67.

In the present preferred embodiment, the hydraulic circuit 70 is preferably arranged on the mating surface between the transmission housing 22 and each of the hydraulic housings 65*a* through 67*a*. This allows downsizing of the hydraulic circuit 70 by utilizing the mating surface between both the housing 22 and the hydraulic housings 65*a* through 67*a* and facilitates a forming of the hydraulic circuit.

Further, the cooling circuit 71 arranged to cool the hydraulic pressure control valves 65 through 67 is arranged on the mating surface between the transmission housing 22 and the hydraulic housings 65*a* through 67*a*. Therefore, the hydraulic pressure control valves 65 through 67 can be cooled by both a headwind and oil, thus enhancing the cooling characteristics, and further improving durability of the hydraulic pressure control valves 65 through 67.

In the present preferred embodiment, the valve shafts 65*d* through 67*d* of the respective hydraulic pressure control valves 65 through 67 are preferably disposed in the watercraft fore-and-aft direction. The hydraulic pressure input passages 65*f* through 67*f* and the hydraulic pressure output passages 65*g* through 67*g* between the hydraulic pressure control valves 65 through 67 are formed in the directions perpendicular, or substantially perpendicular, to the valve shafts 65*d* through 67*d*. Therefore, hydraulic pressure can directly come and go between the hydraulic pressure control valves 65 through 67 and the respective clutches 31, 35, and 43. This achieves a simple configuration of the oil circuit and cost reduction.

In the present preferred embodiment, each of the hydraulic pressure control valves 65 through 67 is preferably disposed above the lower mount member 12. In addition, the level to which each of the hydraulic pressure control valves 65 through 67 protrudes toward the port side is substantially equivalent to the level to which the lower mount member 12 protrudes toward the port side. Therefore, each of the hydraulic pressure control valves 65 through 67 can be disposed without interfering with the lower mount member 12. This prevents an increase in the size of the upper case 9 in the watercraft width direction, thus allowing downsizing of the whole outboard motor 1. That is, if the hydraulic pressure control valves 65 through 67 are disposed to adjoin the lower mount member 12 in the watercraft width direction, the lower mount member 12 needs to protrude outward for the width of the hydraulic pressure control valves 65 through 67. This would result in a problem of size increase of the upper case 9.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an engine arranged to generate power; and a transmission device arranged to transmit a rotational output of the engine to a propeller; wherein the transmission device includes a hydraulic transmission mechanism arranged to change a rotational speed and/or a rotational direction of the rotational output of the engine and a hydraulic pressure control valve arranged to control a hydraulic pressure supplied to the hydraulic transmission mechanism;

a transmission housing is arranged to house the hydraulic transmission mechanism; and the hydraulic pressure control valve is disposed outside of the transmission housing on one side of the outboard motor in a watercraft width direction.

2. The outboard motor according to claim 1, wherein the hydraulic pressure control valve is arranged to protrude in a direction toward the one side of the outboard motor.

3. The outboard motor according to claim 2, wherein the transmission housing includes upper and lower housings joined at least by a fastening bolt disposed on a front side of the outboard motor in a watercraft fore-and-aft direction; and the hydraulic pressure control valve protrudes in a direction toward the one side of the outboard motor at a location rearward of the fastening bolt.

4. The outboard motor according to claim 1, wherein a hydraulic housing arranged to house the hydraulic pressure control valve is detachably mounted on a side wall of the transmission housing, and at least a portion of a hydraulic circuit is arranged on a mating surface between the side wall of the transmission housing and the hydraulic housing.

5. The outboard motor according to claim 4, wherein at least a portion of a cooling circuit arranged to cool the hydraulic pressure control valve by oil injection is arranged on the mating surface between the side wall of the transmission housing and the hydraulic housing.

6. The outboard motor according to claim 1, wherein the hydraulic pressure control valve includes a valve shaft oriented in a watercraft fore-and-aft direction, and an input passage and an output passage of hydraulic pressure to and from the hydraulic pressure control valve are arranged to extend in directions perpendicular or substantially perpendicular to the valve shaft.

7. The outboard motor according to claim 1, wherein the hydraulic pressure control valve is disposed directly above a lower mount member arranged to support the outboard motor.

8. The outboard motor according to claim 7, wherein the hydraulic pressure control valve and the lower mount member are arranged to protrude in the direction toward the one side of the outboard motor, and a level to which the hydraulic pressure control valve protrudes in the direction toward the one side of the outboard motor is substantially equivalent to a level to which the lower mount member protrudes in the direction toward the one side of the outboard motor.

9. The outboard motor according to claim 7, wherein the lower mount member is mounted to an upper case of the outboard motor, and the hydraulic pressure control valve is disposed between the transmission housing and a portion of the upper case.

* * * * *